US007513364B2

(12) United States Patent
Tsai

(10) Patent No.: US 7,513,364 B2
(45) Date of Patent: Apr. 7, 2009

(54) CASING WITH A LOCKING UNIT

(75) Inventor: Simon Tsai, Taichung (TW)

(73) Assignee: Gau Woei Super Hard Tool Co., Ltd. (TW)

( * ) Notice: Subject to any disclaimer, the term of this patent is extended or adjusted under 35 U.S.C. 154(b) by 920 days.

(21) Appl. No.: 10/978,108

(22) Filed: Oct. 29, 2004

(65) Prior Publication Data

US 2006/0091032 A1 May 4, 2006

(51) Int. Cl.
*B65D 85/00* (2006.01)

(52) U.S. Cl. ..... 206/379; 206/372; 206/1.5

(58) Field of Classification Search ..... 206/372–375, 206/207; 220/324, 763; 190/115, 119
See application file for complete search history.

(56) References Cited

U.S. PATENT DOCUMENTS 4,157,763 A * 6/1979 Betlejewski et al. ..... 220/761
4,660,719 A * 4/1987 Peterson et al. ..... 206/379
7,219,969 B2 * 5/2007 Bezzubov ..... 312/107
2006/0226042 A1 * 10/2006 Seymour et al. ..... 206/379

* cited by examiner

*Primary Examiner*—Mickey Yu
*Assistant Examiner*—Jose S Stephens, III
(74) *Attorney, Agent, or Firm*—Sheridan Ross P.C.

(57) ABSTRACT

A casing includes a base, a cover, and a locking unit. The base has a top opening. The cover is coupled pivotally to the base, and is pivotable relative to the base from an opened position to a closed position, where the cover covers the top opening of the base. The locking unit includes a locking mechanism for retaining selectively the cover in the closed position. The locking mechanism includes a locking protrusion formed on the cover, a receiving groove formed on the cover around the locking protrusion, and a handle that is coupled pivotally to the base. The handle is pivotable relative to the base from an unlocking position to a locking position, where the handle is received in the receiving groove and engages the locking protrusion when the cover is disposed at the closed position.

5 Claims, 7 Drawing Sheets

CASING WITH A LOCKING UNIT

BACKGROUND OF THE INVENTION

1. Field of the Invention

The invention relates to a casing, more particularly to a casing that has a locking unit.

2. Description of the Related Art

FIG. 1 illustrates a conventional toolbox 1 that includes a base 11, a tool holder 12, a cover 13, and a locking mechanism. The tool holder 12 is mounted fixedly in the base 11, and has a plurality of compartments 121. The cover 13 is coupled pivotally to the base 11, and is pivotable relative to the base 11 from an opened position, where the cover 13 exposes the compartments 121 of the tool holder 12, to a closed position, where the cover 13 covers the compartments 121 of the tool holder 12. The locking mechanism is operable so as to retain the cover 13 at the closed position. In particular, the locking mechanism includes a pair of locking parts 15 formed on the base 11, and a pair of snap hooks 14 formed on the cover 13. Each of the snap hooks 14 is snapped into engagement with a respective one of the locking parts 15 when the cover 13 is disposed at the closed position.

The aforementioned conventional toolbox 1 is disadvantageous in that it is relatively easy for the snap hooks 14 to snap off undesirably from the locking parts 15. Moreover, since the tool holder 12 is mounted fixedly in the base 11, the tool holder 12 is irreplaceable.

SUMMARY OF THE INVENTION

Therefore, the object of the present invention is to provide a casing capable of overcoming the aforesaid drawbacks of the prior art.

According to the present invention, a casing comprises a base, a cover, and a locking unit. The base defines an accommodating space and has a top opening. The cover is coupled pivotally to the base, and is pivotable relative to the base from an opened position to a closed position, where the cover covers the top opening of the base. The locking unit includes a locking mechanism for retaining selectively the cover in the closed position. The locking mechanism includes a locking protrusion, a U-shaped receiving groove, and a U-shaped handle. The locking protrusion is formed on the cover. The receiving groove is formed on the cover around the locking protrusion, and includes a pair of opposite groove sections and a transverse groove section. The handle is coupled pivotally to the base, and includes a pair of opposite arms and a transverse arm. The handle is pivotable relative to the base from a first unlocking position to a first locking position, where each of the arms is received in a respective one of the groove sections, and the transverse arm is received in the transverse groove section and engages the locking protrusion when the cover is disposed at the closed position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
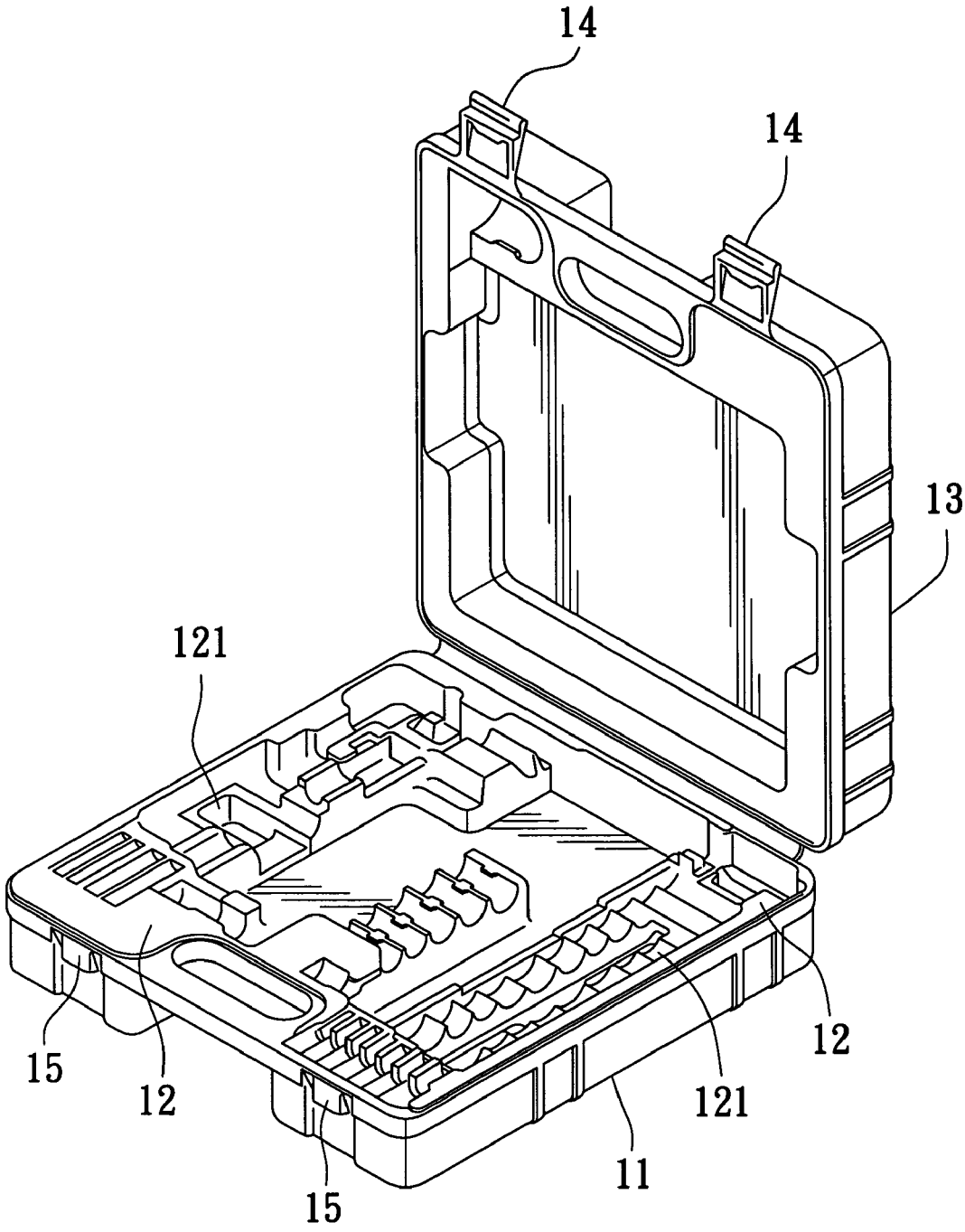
FIG. 1 PRIOR ART
FIG. 1 is a perspective view of a conventional toolbox.
Figure 2:
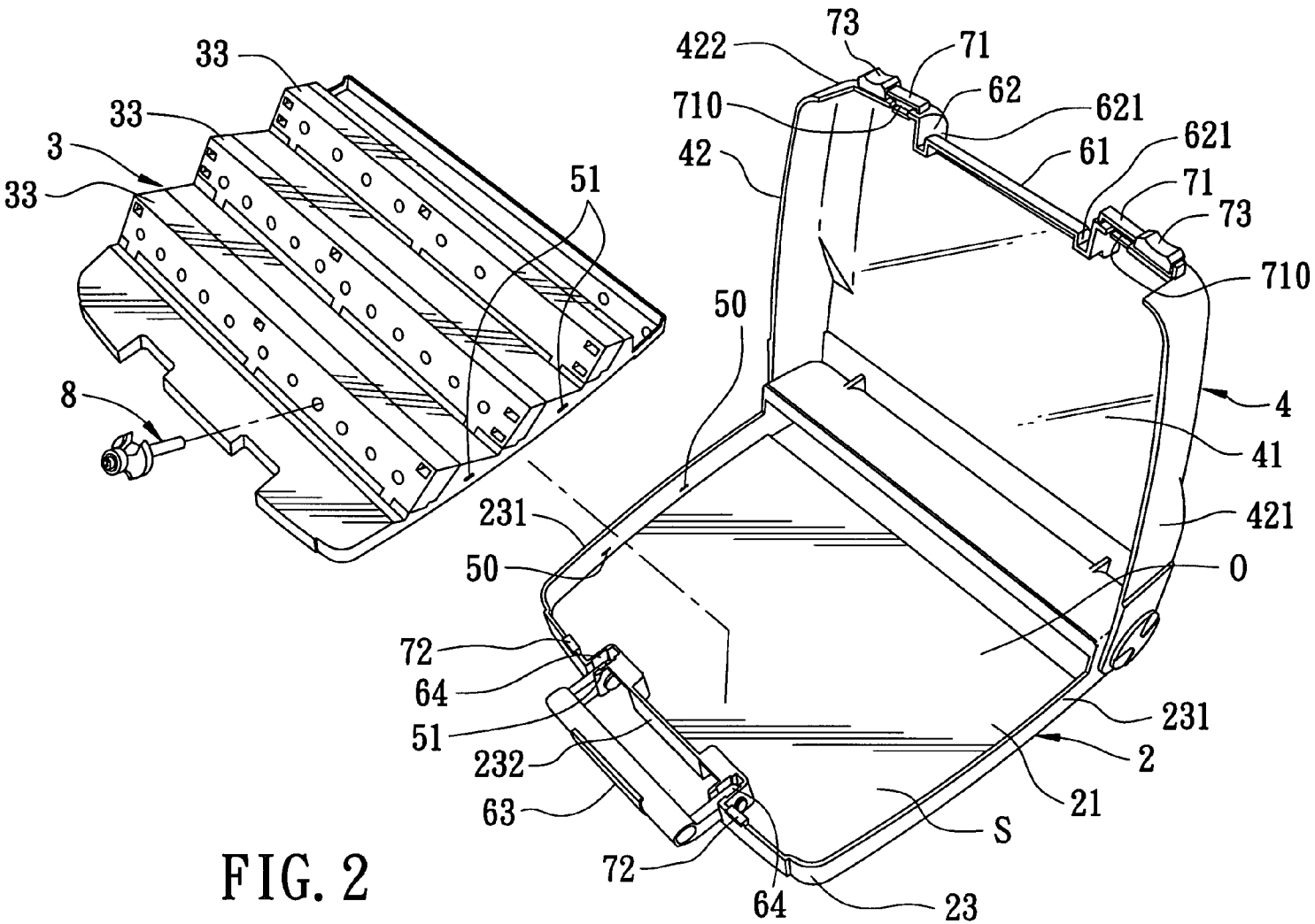
FIG. 2 is an exploded a perspective view of the preferred embodiment of a casing according to the present invention.
Figure 3:
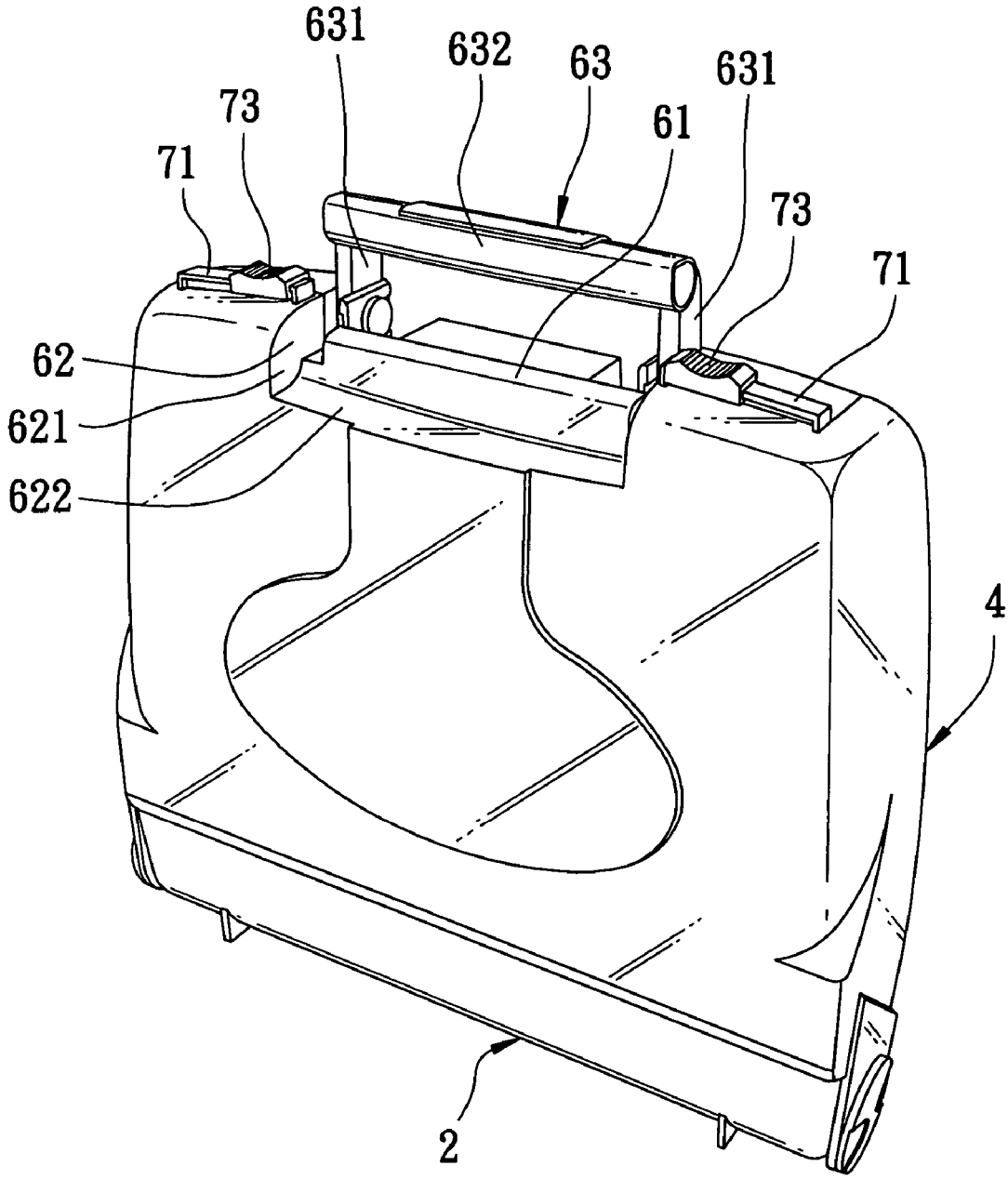
FIG. 3 is a perspective view of the preferred embodiment to illustrate a state where a cover is disposed at a closed position.

Referring to FIGS. 2 and 3, the preferred embodiment of a casing according to this invention includes a base 2, a cover 4, and a locking unit.

The casing of this embodiment is generally rectangular in shape, and is applied as a tool box.

The base 2 defines an accommodating space (S), and has a top opening (O). In this embodiment, the base 2 includes a base part 21, and a surrounding wall 23 that extends from a periphery of the base part 21, that surrounds the accommodating space (S), and that defines the top opening (O). The surrounding wall 23 of the base 2 includes a pair of parallel wall parts 231, each of which has opposite first and second ends, and a transverse wall part 232 that interconnects the first ends of the wall parts 231 of the surrounding wall 23 of the base 2.

The cover 4 includes a transparent cover part 41, and a surrounding wall 42 that extends from a periphery of the cover part 41. The surrounding wall 42 of the cover 4 includes a pair of parallel wall parts 421, each of which has opposite first and second ends, and a transverse wall part 422 that interconnects the first ends of the wall parts 421 of the surrounding wall 42 of the cover 4. The second end of each of the wall parts 421 of the surrounding wall 42 of the cover 4 is connected pivotally to the second end of a respective one of the wall parts 231 of the surrounding wall 23 of the base 2. The cover 4 is pivotable relative to the base 2 from an opened position, where the cover 4 exposes the top opening (O) of the base 2, as best shown in FIG. 2, to a closed position, where the cover 4 covers the top opening (O) of the base 2, as best shown in FIG. 3.

The locking unit includes a first locking mechanism that retains selectively the cover 4 in the closed position. In particular, the first locking mechanism includes a locking protrusion 61 (see FIGS. 2 and 3), a U-shaped receiving groove 62, and a U-shaped handle 63. The locking protrusion 61 is formed on the transverse wall part 422 of the surrounding wall 42 of the cover 4. The receiving groove 62 is formed on the transverse wall part 422 of the surrounding wall 42 of the cover 4 around the locking protrusion 61, and includes a pair of opposite groove sections 621 and a transverse groove section 622. The handle 63 includes a pair of opposite arms 631 and a transverse arm 632. Each of the arms 631 has a first end portion that is connected pivotally to the transverse wall part 232 of the surrounding wall 23 of the base 2, and a second end portion opposite to the first end portion of a respective one of the arms 631 of the handle 63. The transverse arm 632 of the handle 63 interconnects the second end portions of the arms 631 of the handle 63.

Figure 4:
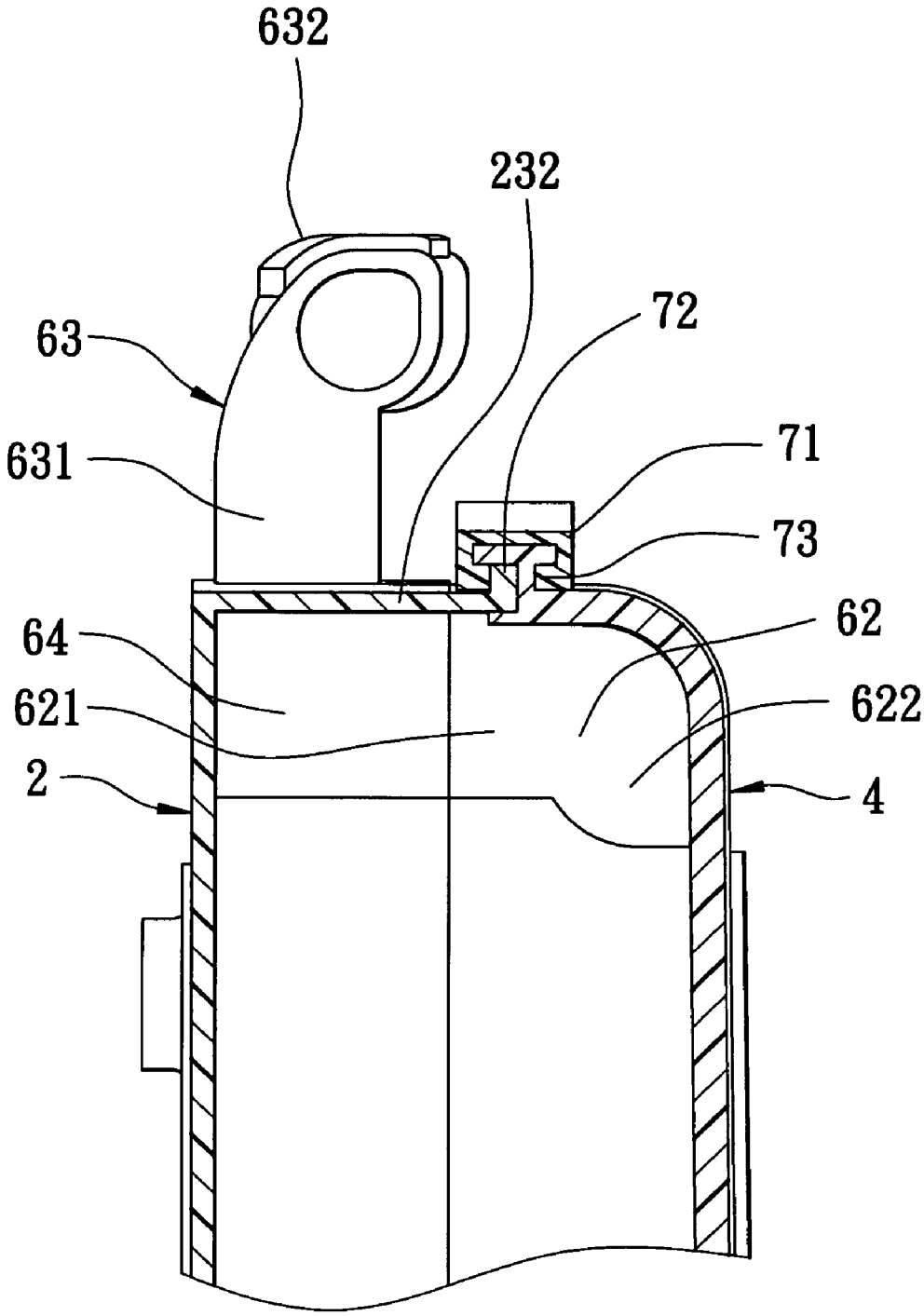
FIG. 4 is a fragmentary sectional view of the preferred embodiment to illustrate a state where a handle is disposed at an unlocking position.
Figure 5:
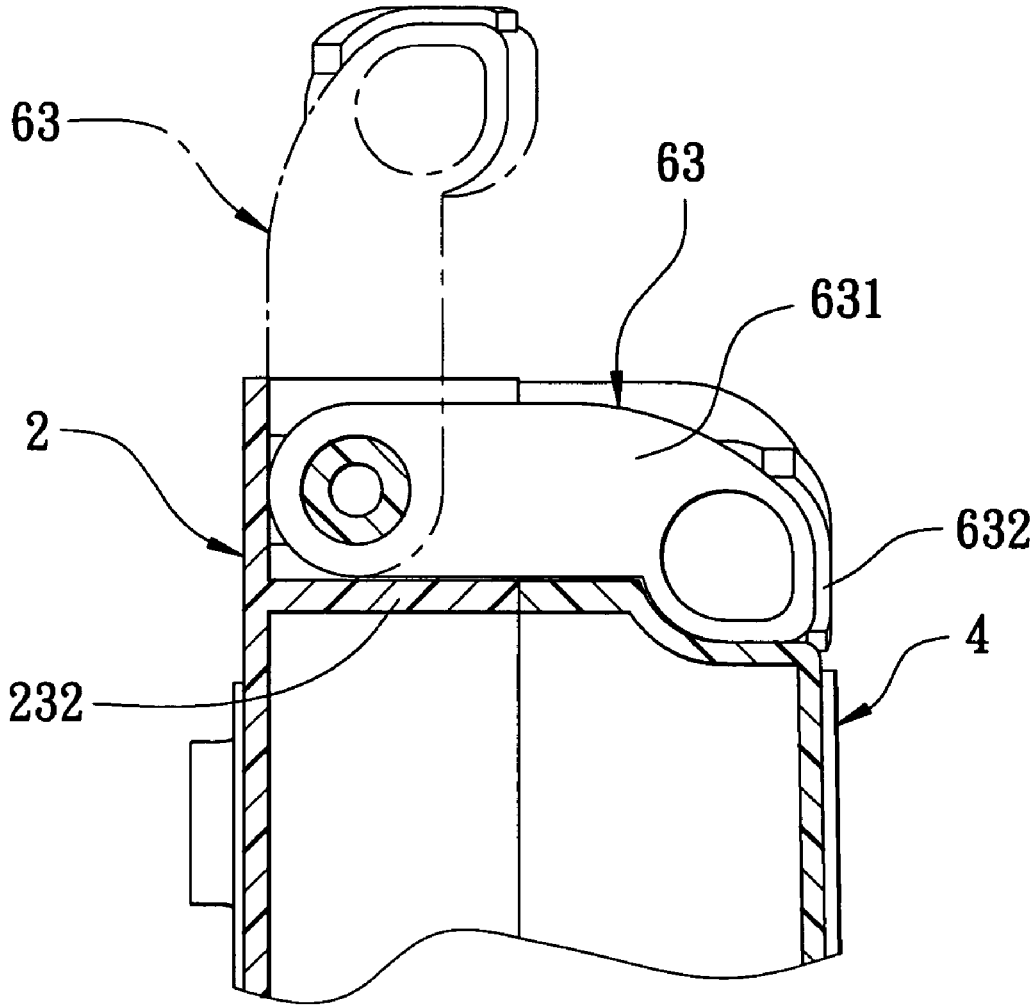
FIG. 5 is a fragmentary sectional view of the preferred embodiment to illustrate a state where the handle is disposed at a locking position.

Referring to FIGS. 4 and 5, the handle 63 is pivotable relative to the base 2 from a first unlocking position, where the transverse arm 632 of the handle 63 is disposed externally of the transverse groove section 622 of the receiving groove 62, as best shown in FIG. 4, to a first locking position, where the second end portion of each of the arms 631 of the handle 63 is receive in a respective one of the groove sections 621 of the receiving groove 62, and the transverse arm 632 of the handle 63 is received in the transverse groove section 622 of the receiving groove 62 and engages the locking protrusion 61 (see FIG. 2) when the cover 4 is disposed at the closed position, as best shown in FIG. 5. It is noted that the transverse wall part 232 of the surrounding wall 23 of the base 2 is formed with a pair of opposite receiving recesses 64 (see FIG. 2), each of which is registered with a respective one of the groove sections 621 of the receiving groove 62 in the cover 4 when the cover 4 is disposed at the closed position. The first end portion of each of the arms 631 of the handle 63 is received in a respective one of the receiving recesses 64 in the transverse wall part 232 of the surrounding wall 23 of the base 2, as best shown in FIG. 5.

Referring back to FIGS. 2 and 3, the locking unit further includes a second locking mechanism that retains the cover 4 in the closed position. In particular, the second locking mechanism includes a pair of slide rails 71, a pair of tabs 72, and a pair of sliding members 73. Each of the slide rails 71 is mounted on the transverse wall part 422 of the surrounding wall 42 of the cover 4, and defines a locking groove 710. Each of the tabs 72 is formed on a periphery of the transverse wall part 232 of the surrounding wall 23 of the base 2, and is received in the locking groove 710 in a respective one of the slide rails 71 when the cover 4 is disposed at the closed position, as best shown in FIG. 4. Each of the sliding members 73 is coupled slidably to a respective one of the slide rails 71. In this embodiment, each of the sliding member 73 is slidable along the respective one of the slide rails 71 between a second locking position, where the sliding members 73 engage the tabs 72 so as to retain the tabs 72 in the locking grooves 710 in the slide rails 71, as best shown in FIG. 4, and a second unlocking position, where the sliding members 73 disengage the tabs 72 so as to permit outward movement of the tabs 72 from the locking grooves 710 in the slide rails 710.

Figure 6:
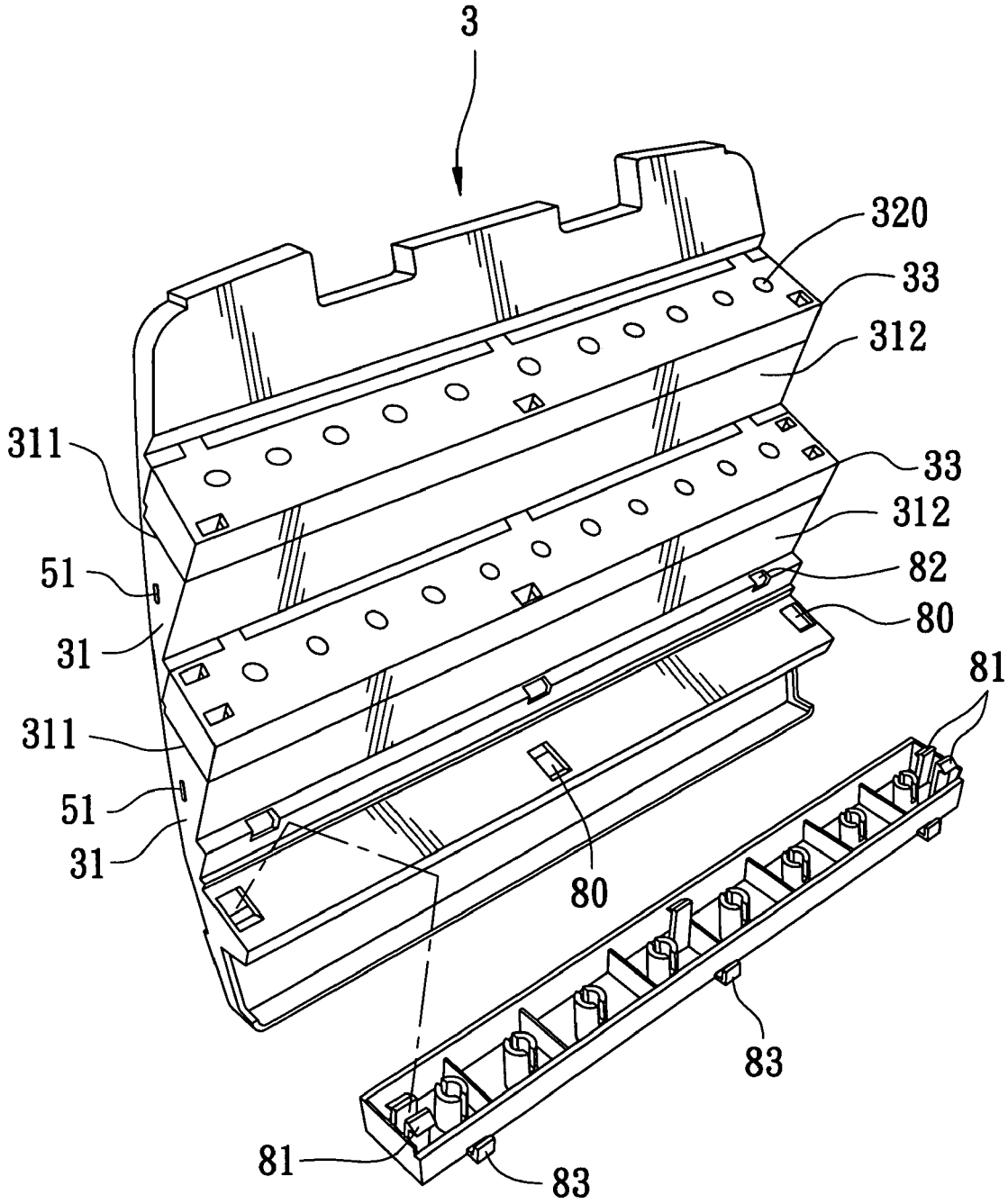
FIG. 6 is an exploded perspective view to illustrate a mounting seat of the preferred embodiment.

The casing further includes a mounting seat 3 that serves to hold tools 8 thereon, that is disposed in the accommodating space (S) of the base 2, and that is fastened releasably to the wall parts 231 of the surrounding wall 23 of the base 2. In particular, with further reference to FIG. 6, the mounting seat 3 is formed with a plurality of ridges 31, each of which has opposite first and second walls 311, 312. The second wall 312 of each of the ridges 31 cooperates with the first wall 311 of an adjacent one of the ridges 31 to form a V-shaped groove. The casing further includes a first fastening unit that fastens releasably the mounting seat 3 to the wall parts 231 of the surrounding wall 23 of the base 2. In this embodiment, the first fastening unit includes a plurality of notches 50 that are formed on the wall parts 231 of the surrounding wall 23 of the base 2, and a plurality of tongues 51 that are formed on the ridges 31 of the mounting seat 3. Each of the tongues 51 engages a respective one of the notches 50 when the mounting seat 3 is disposed in the accommodating space (S) of the base 2.

The mounting seat 3 includes a plurality of tool holders 33, each of which is mounted releasably to the first wall 311 of a respective one of the ridges 31. In particular, the casing further includes a second fastening unit that fastens releasably each of the tool holders 33 to the first wall 311 of the respective one of the ridges 31. The second fastening unit includes a plurality of fastening holes 80 that are formed in the first wall 311 of each of the ridges 31, and a plurality of hook fasteners 81 that are formed on each of the tool holders 33. Each of the hook fasteners 81 engages a respective one of the fastening holes 80 when the tool holder 33 is mounted on the first wall 311 of the respective ridge 31. The construction as such permits the tool holders 33 of the casing of this invention to be replaceable.

The second fastening unit further includes a pair of L-shaped grooves 82 formed in a junction of two adjacent ones of the ridges 31, and a pair of L-shaped hooks 83 formed on each of the tool holders 33 for guiding fastening of the tool holder 33 on the first wall 311 of the respective ridge 31. Each of the hooks 83 extends into a respective one of the grooves 82 at the junction of two adjacent ones of the ridges 31 when the tool holder 33 is mounted on the first wall 311 of the respective ridge 31.

Figure 7:
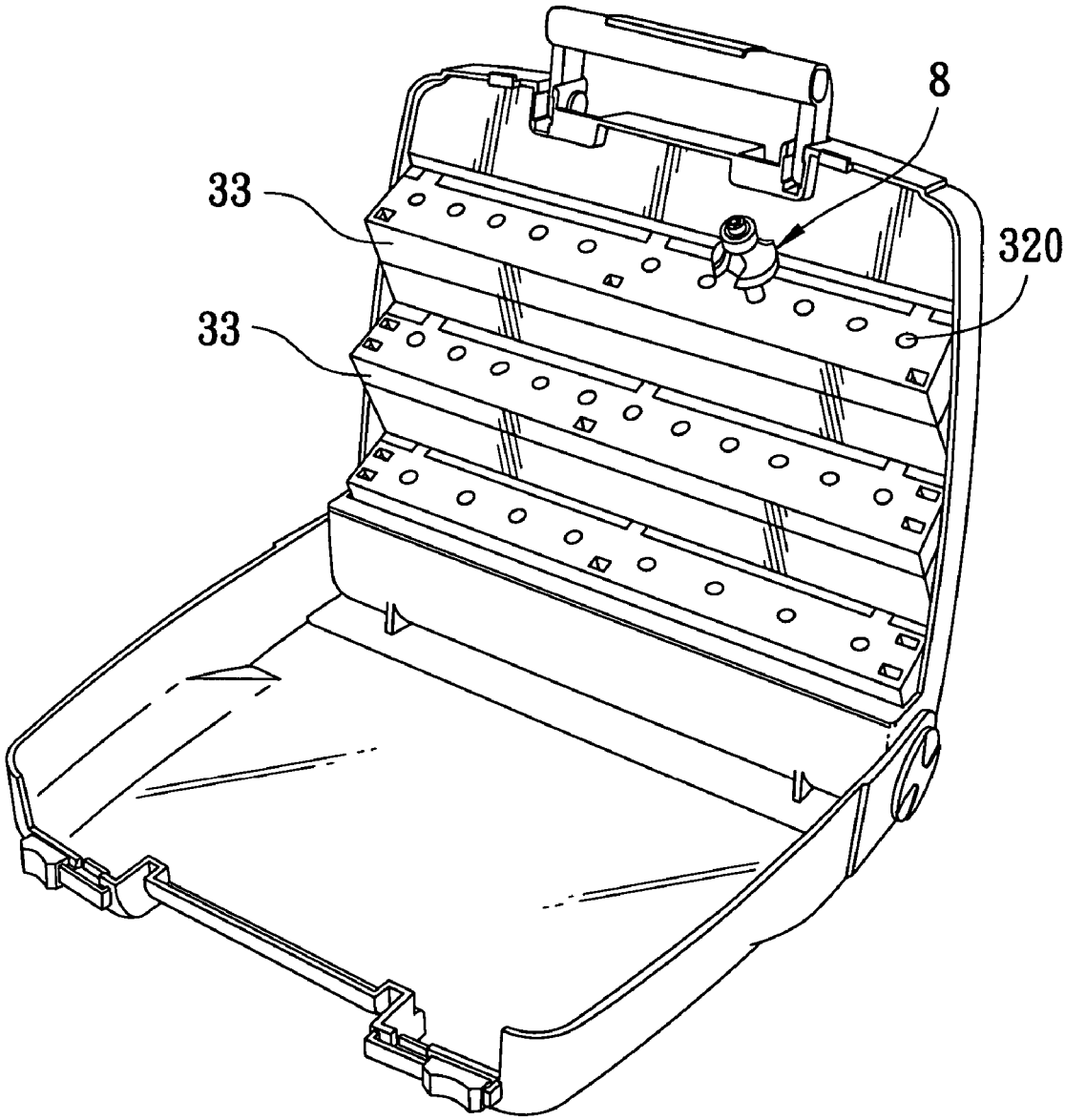
FIG. 7 is a perspective view to illustrate the mounting seat of the preferred embodiment in a state of use.

With further reference to FIG. 7, each of the tool holders 33 is formed with a plurality of spaced apart bores 320. Each of the bores 320 receives an end portion of a respective one of the tools 8.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A casing comprising:

a base defining an accommodating space, having a top opening, and including a surrounding wall that surrounds said accommodating space and that defines said top opening;

a cover coupled pivotally to said base, said cover being pivotable relative to said base from an opened position to a closed position, where said cover covers said top opening in said surrounding wall of said base;

a locking unit including a first locking mechanism for retaining selectively said cover in the closed position, said first locking mechanism including a locking protrusion formed on said cover, a U-shaped receiving groove that is formed on said cover around said locking protrusion, and that includes a pair of opposite groove sections and a transverse groove section, and a U-shaped handle that is coupled pivotally to said base, and that includes a pair of opposite arms and a transverse arm, said handle being pivotable relative to said base from a first unlocking position to a first locking position, where each of said arms is received in a respective one of said groove sections, and said transverse arm is received in said transverse groove section and engages said locking protrusion when said cover is disposed at the closed position;

a mounting seat adapted for holding tools, said mounting seat being disposed in said accommodating space of said base and being fastened releasably to said surrounding wall of said base, said mounting seat including a plurality of tool holders, each of which is formed with a plurality of spaced apart bores, each of said bores being adapted to receive an end portion of a respective one of the tools, said mounting seat being formed with a plurality of ridges, each of which has opposite first and second walls, said second wall of one of said ridges cooperating with said first wall of an adjacent one of said ridges to form a V-shaped groove, each of said tool holders being mounted releasably to said first wall of a respective one of said ridges: and a fastening unit for fastening releasably each of said tool holders to said first wall of the respective one of said ridges, said fastening unit including:

a plurality of fastening holes that are formed in said first wall of the respective one of said ridges, a plurality of hook fasteners formed on each of said tool holders, each of said hook fasteners engaging a respective one of said fastening holes when said tool holder is mounted on said first wall of the respective one of said ridges.

2. The casing as claimed in claim 1, wherein said locking unit further includes a second locking mechanism for retaining said cover in the closed position, said second locking mechanism including a slide rail that is mounted on said cover and that defines a locking groove, a tab formed on said base and received in said locking groove in said slide rail when said cover is disposed at the closed position, and a sliding member coupled slidably to said slide rail, and slidable along said slide rail between a second locking position, where said sliding member engages said tab so as to retain said tab in said locking groove in said slide rail, and a second unlocking position, where said sliding member disengages said tab so as to permit outward movement of said tab from said locking groove in said slide rail.

3. The casing as claimed in claim 1, wherein said base is formed with a pair of opposite receiving recesses, each of which is registered with a respective one of said groove sections of said receiving groove in said cover when said cover is disposed at the closed position, each of said arms of said handle having an end portion that is received in a respective one of said receiving recesses in said base.

4. The casing as claimed in claim 1, further comprising another fastening unit for fastening releasably said mounting seat to said surrounding wall of said base, said another fastening unit including a plurality of notches that are formed on said surrounding wall of said base, and a plurality of tongues that are formed on said mounting seat, each of said tongues engaging a respective one of said notches when said mounting seat is disposed in said accommodating space of said base.

5. The casing as claimed in claim 1, wherein said fastening unit further includes an L-shaped groove that is formed in a junction of two adjacent ones of said ridges, and an L-shaped hook that is formed on each of said tool holders, said hook extending into said L-shaped groove at the junction of two adjacent ones of said ridges when said tool holder is fastened to said first wall of the respective one of said ridges.

* * * * *